United States Patent [19]

Prichard et al.

[11] 3,955,514

[45] May 11, 1976

[54] YARN FEED ROLLER ASSEMBLY

[75] Inventors: Richard J. Prichard, Chattanooga; Jimmie D. Scott, Harrison, both of Tenn.

[73] Assignee: The Singer Company, New York, N.Y.

[22] Filed: Mar. 7, 1975

[21] Appl. No.: 556,233

[52] U.S. Cl. ..... 112/79 A

[51] Int. Cl.[2] ..... D05C 15/32

[58] Field of Search ..... 112/79 A, 79 R, 78

[56] References Cited

UNITED STATES PATENTS

| | | | |
|---|---|---|---|
| 3,224,395 | 12/1965 | Card | 112/79 R |
| 3,272,163 | 9/1966 | Erwin et al. | 112/79 R |
| 3,489,326 | 1/1970 | Singleton | 112/79 A |
| 3,605,660 | 9/1971 | Short | 112/79 A |
| 3,847,098 | 11/1974 | Hammel | 112/79 A |

*Primary Examiner*—H. Hampton Hunter
*Attorney, Agent, or Firm*—Edward L. Bell; Robert E. Smith; Alan Ruderman

[57] ABSTRACT

A yarn feed roller assembly for tufting machine pattern attachments for controlling the amount of yarn supplied to the needles of the tufting machine in accordance with a pattern. The assembly includes a plurality of parallel modules each of which comprises a housing mounting a shaft on which a plurality of clutch members and respective drive members are mounted within the housing. A yarn feed roller is secured to one end of the shaft which extends outside the module housing. Means are provided to drive each drive member of the module at a different speed, corresponding drive members of all the modules being drivingly connected to one another. The clutches are selectively energized to transmit the speed of a selected drive member to the shaft and thereby to the roller. All the module housings are mounted in cantilevered fashion on a frame and each may be individually readily removed for maintenance.

12 Claims, 7 Drawing Figures

YARN FEED ROLLER ASSEMBLY

BACKGROUND OF THE INVENTION

This invention relates to textile machinery, such as tufting machines and the like, and is particularly directed to yarn feed roller pattern attachments therefor.

Wide use is being made of pattern attachments for producing variations in pile height in pile fabric such as carpeting. Representative of such pattern attachments are those disclosed in the following U.S. Pats: Card, No. 2,862,465; Nix, No. 2,875,714; Card, No. 2,966,866; MacCaffray, No. 3,001,388; Card, No. 3,075,482; Hammel, No. 3,103,187; Beasley, No. 3,134,529; Card, No. 3,207,105; Card, No. 3,224,395; Erwin, et.al., No. 3,272,163; Singleton, No. 3,489,326; Short, No. 3,605,660; Short, No. 3,752,094; and Hammel, No. 3,847,098. These attachments include a plurality of yarn feed rollers which feed yarn to the needles of the tufting machine. Each of the feed rollers is selectively driven at one of a plurality of different speeds independently of the other feed rolls by means of clutches controlled by a pattern control. The amount of yarn supplied to the needles of a tufting machine or the like is determined by the rotational speed of the feed rollers on which the yarn strand is wound, so that with a fixed needle stroke the amount of yarn supplied to the needle determines the pile height of the pile fabric produced. To create patterned pile effects the amount of yarn fed to the individual needles may be varied by driving the feed rolls selectively at different speeds.

With the exception of the disclosures in the two aforementioned Short patents, each feed roller of the prior art attachments feeds a plurality of yarn ends to selected needles. Since each needle receiving yarn from a given roller must necessarily always produce a pile loop of the same height as that of the other needles receiving yarn from that roller, the number of pattern repeats across the width of the work products is limited. For example, a tufting machine for producing carpeting may have 1,200 needles spaced transversely across the machine. If a pattern attachment having 120 feed roller sets controls the feeding of the yarn ends, there would be ten pattern repeats across the face of the carpet and each roller set would control ten yarn ends. If eight repeats are desired, then 150 roller sets would be required if the same carpet were produced. If less rolls were available, e.g. 120, then eight repeats would be obtained by sewing a smaller width or by increasing the gauge so that only 960 needles would be used.

The limitations on the number of rollers restricts the carpet designer to designs which repeat frequently across the width of the carpet. It would therefore be desirable to have a pattern attachment capable of individual yarn end control or at least approaching such control. Due to space limitations the prior art designs have not generally been adoptable to the large number of rollers required for individual yarn control. The Short patents are attempts toward this end.

Each yarn feed roller type of pattern attachment comprises a large number of clutches. As pointed out in the aforesaid Hammel U.S. Pat. No. 3,847,098, the clutch members generally wear out or become defective before the other parts and must be replaced for service periodically. Unless the pattern attachment is designed with service in mind, the amount of "downtime" would be excessive with the additional costs reflected in the price of the carpeting. With an attachment having the number of rollers approaching individual yarn end control, the amount of down-time would be staggering if servicing would require more than a minimal amount of down-time. The result of this would be to make such multi-roller controls unfeasible for economical carpet production.

SUMMARY OF THE INVENTION

The present invention provides a yarn feed roller assembly for a pattern attachment which combines the features of a compact design adapted for individual yarn end control with the feature of a serviceable design that can reduce down-time to a matter of minutes.

Essentially, the invention provides a roller assembly comprising a multiplicity of modules mounted parallel within a frame. Each module comprises a housing individually supported on the frame independently of the other modules and may be removed and replaced conveniently in a matter of minutes. Each module includes a plurality of clutch members equal to the number of desired roller speeds and an associated drive member continuously rotated at the respective speed. The clutches are coupled selectively to the associated drive member to transmit the selected speed to the shaft. A yarn feed roller is mounted on one end of each shaft externally of the module housing and is threaded with yarn which is fed to selective needles in an amount dependent upon the rotational speed of the shaft. Each module is of a compact design which may be stacked vertically and horizontally so that individual needle control is obtainable by stacking a large number of modules equal to the number of needles. In the preferred embodiment of the invention, a large number of corresponding module drive members are driven together by common means, which may, for example, comprise an endless drive member which snakes about the assembly and peripherally engages the respective drive member of each module.

Accordingly, it is a primary object of this invention to provide an extremely compact and readily serviceable yarn feed assembly for a pile forming machine pattern attachment.

It is another object of this invention to provide a yarn feed roller assembly for a tufting machine that is so compact that an individual yarn feed roller for each tufting machine needle is attainable.

It is a further object of this invention to provide a multi-yarn feed roller assembly having components that are accessible for maintenance.

It is a still further object of this invention to provide a yarn feed roller assembly for tufting machines and the like having a plurality of modules each including a feed roller and a plurality of clutch and drive members in removable driving engagement with fixed drive means for driving said feed roller at selective yarn feed speeds.

It is a yet still further object of this invention to provide a yarn feed roller assembly for tufting machines and the like having a plurality of modules in which the modules may be independently stacked within the assembly and independently detachable from the assembly for rapid maintenance and replacement.

BRIEF DESCRIPTION OF THE DRAWINGS

Other objects and advantages of this invention will best be understood upon reading the following detailed description of the invention with the accompanying drawings, in which.

DETAILED DESCRIPTION OF THE PREFERRED EMBODIMENT

Figure 3:
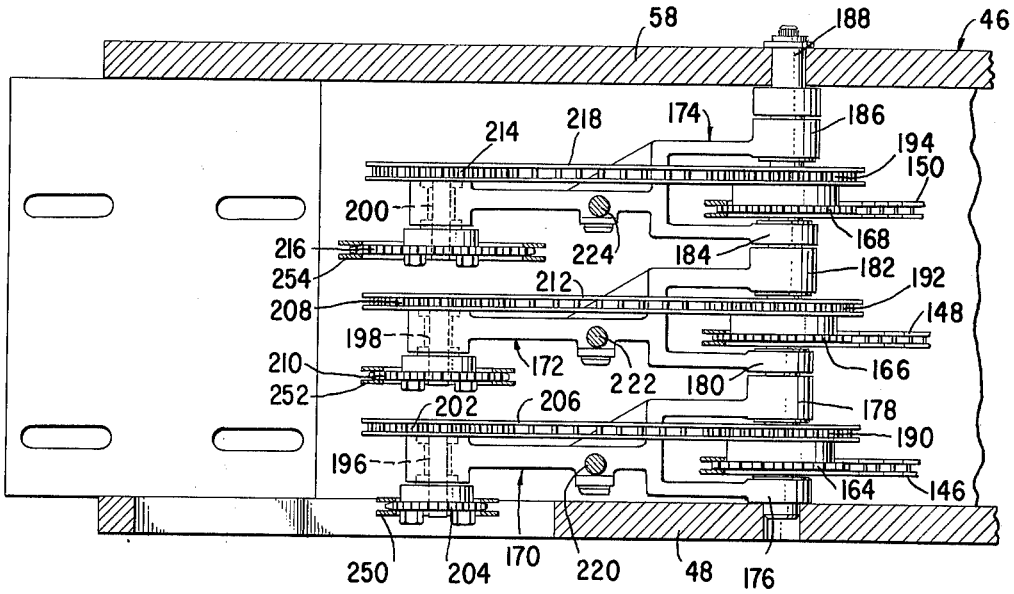
FIG. 3 is a sectional view taken substantially along the lines 3—3 of FIG. 2 illustrating a portion of the drive mechanism.
Figure 1:
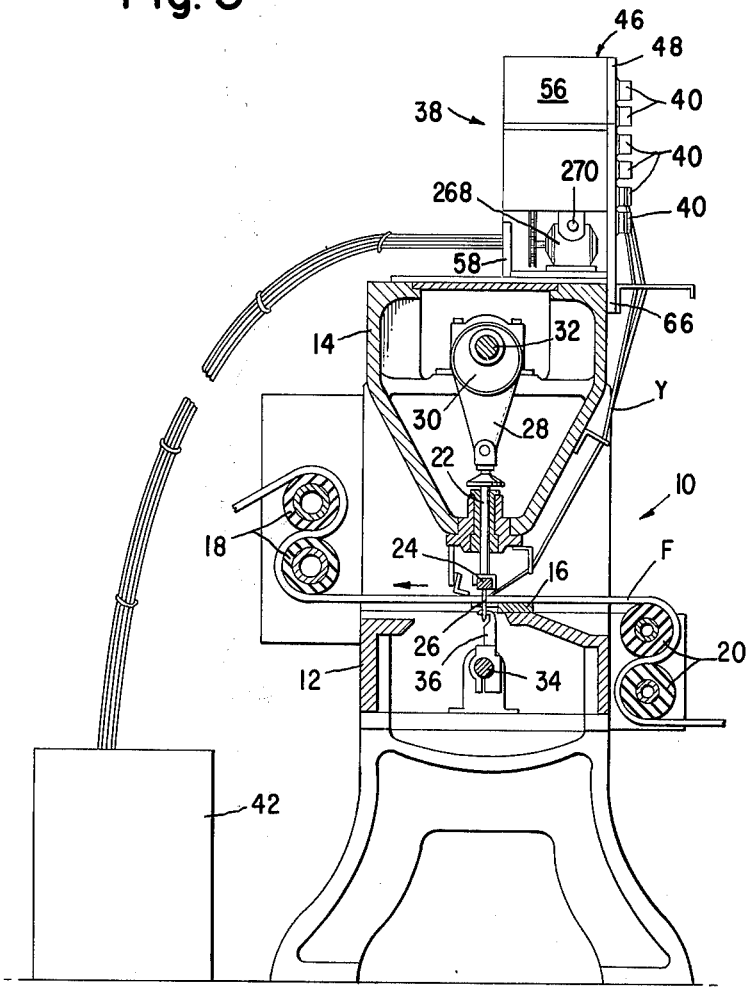
FIG. 1 is a end elevational view of a tufting machine incorporating a pattern attachment including a yarn feed assembly constructed in accordance with the present invention.

Referring now to the drawings, there is illustrated in FIG. 1 a tufting machine 10 having a frame comprising of base 12 and a head 14 disposed above the base 12. The base 12 includes a bed plate 16 across which a fabric F is adapted to be fed by a pair of feed rolls 18 and take-off rolls 20.

Mounted in the head 14 for vertical reciprocation is a push rod 22 to the lower end of which is received a needle bar 24 which in turn carries a plurality of needles 26 that are adapted to penetrate the fabric F on the bed plate 16 upon reciprocation of the needle bar 24 and to project loops of yarn therethrough. Endwise reciprocation is imparted to the push rod 22 and thus the needle bar 24 and needles 26 by a link 28 which is pivotably connected at its lower end to the push rod 22 and at its upper end to an eccentric 30 on a driven rotary main shaft 32 that is journalled longitudinally of the head 14. While a plurality of push rods 22, links 28, eccentrics 30 and needles 26 are normally provided along the main shaft 32, only one set thereof is illustrated in the drawings.

Beneath the bed plate 16 there is journalled an oscillating looper shaft 34 which is arranged parallel to the main shaft 32 and which carries a looper 36. Each looper 36 cooperates with a needle 26 to seize a loop of yarn presented thereby and holds the same as the needle is withdrawn on its return stroke, after which the looper retracts to release the loop. While, to simplify the disclosure, only a single looper 36 is shown, it is understood that one looper is provided for each needle in the machine.

Yarn Y is fed to the needles 26 by a pattern attachment including a yarn feed roller assembly 38 having a multiplicity of rollers 40 which may be mounted on the head of the tufting machine as illustrated. The amount of yarn supplied to the needles of the tufting machine is determined by the rotational speed of the feed rollers on which the yarn strands are wound, so that with a fixed needle stroke the amount of yarn supplied to the needle determines the pile height of the pile fabric produced. To create pattern pile effects the amount of yarn feed to the individual needles may be varied by driving the feed rolls selectively at different speeds. As hereinafter described the speed of the yarn feed rollers are determined by a pattern control mechanism 42, which as illustrated may be a console remote from the tufting machine. A console of this type is illustrated in U.S. Patent of Irwin, et.al. No. 3,272,163.

Figure 2:
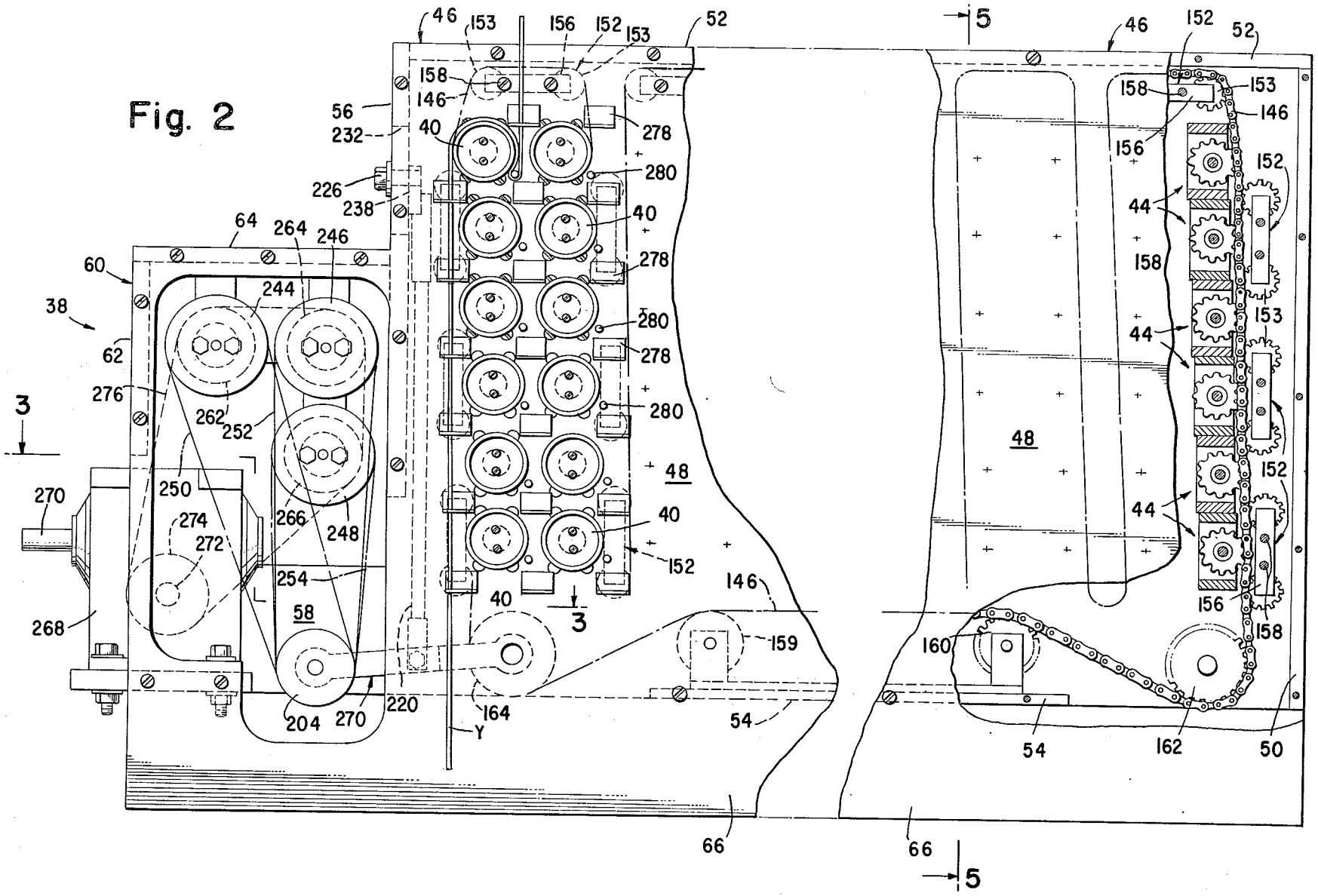
FIG. 2 is an enlarged front view, partially broken away, of a portion of the yarn feed assembly illustrated in FIG. 1.
Figure 4:
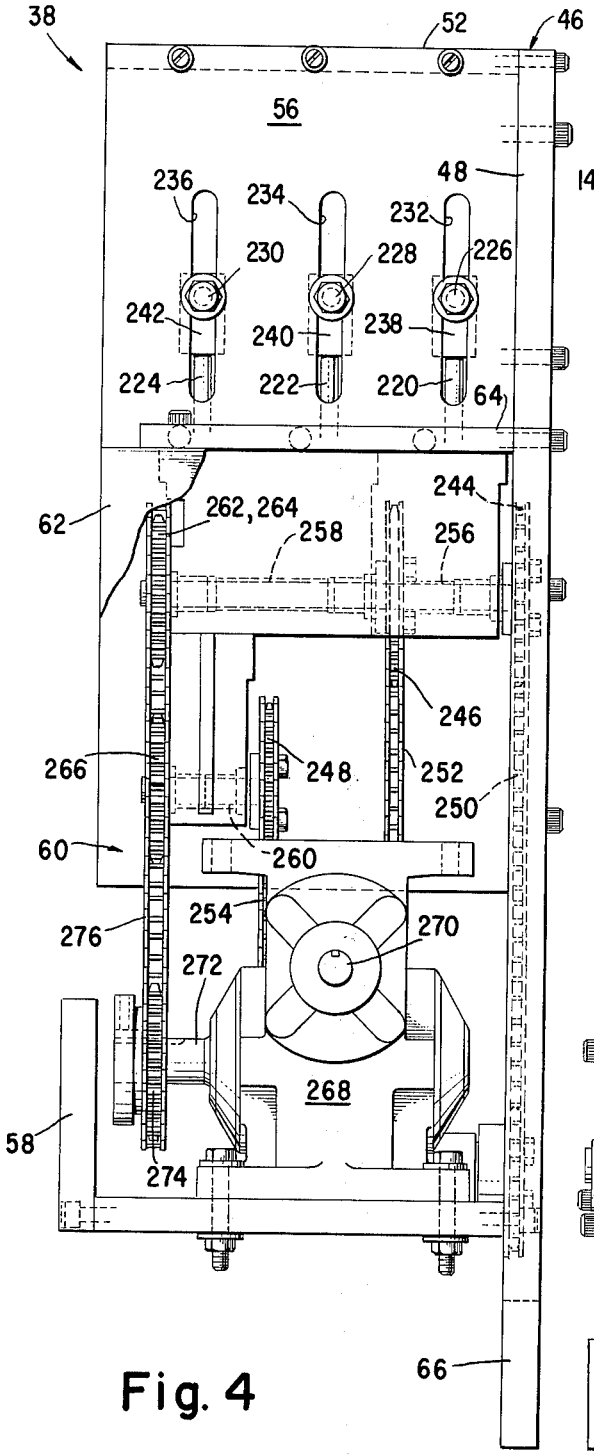
FIG. 4 is an elevational view of the yarn roller assembly as viewed from the left end of FIG. 2.

In accordance with the principles of the present invention the yarn feed attachment 38 comprises a multiplicity of roller modules 44 mounted in a support frame 46. The frame may comprise a front plate 48, an end plate 50 and a top plate 52 secured together into a substantially box-like configuration. To add rigidity to the frame a bottom support plate 54 and an end stiffener 56 may be secured to the plate 48. A back support plate 58 may be provided for additional stiffness. One end, as illustrated in FIG. 2, is reduced in size to define a drive box 60 and includes an end stiffener plate 62 secured to the front plate 48 and an upper stiffener plate 64 secured to the plates 48 and 62. The frame 46 may be mounted on the head of the tufting machine 10 with a skirt portion 66 of the plate 48 overhanging the front edge of the head and secured thereto.

Figure 5:
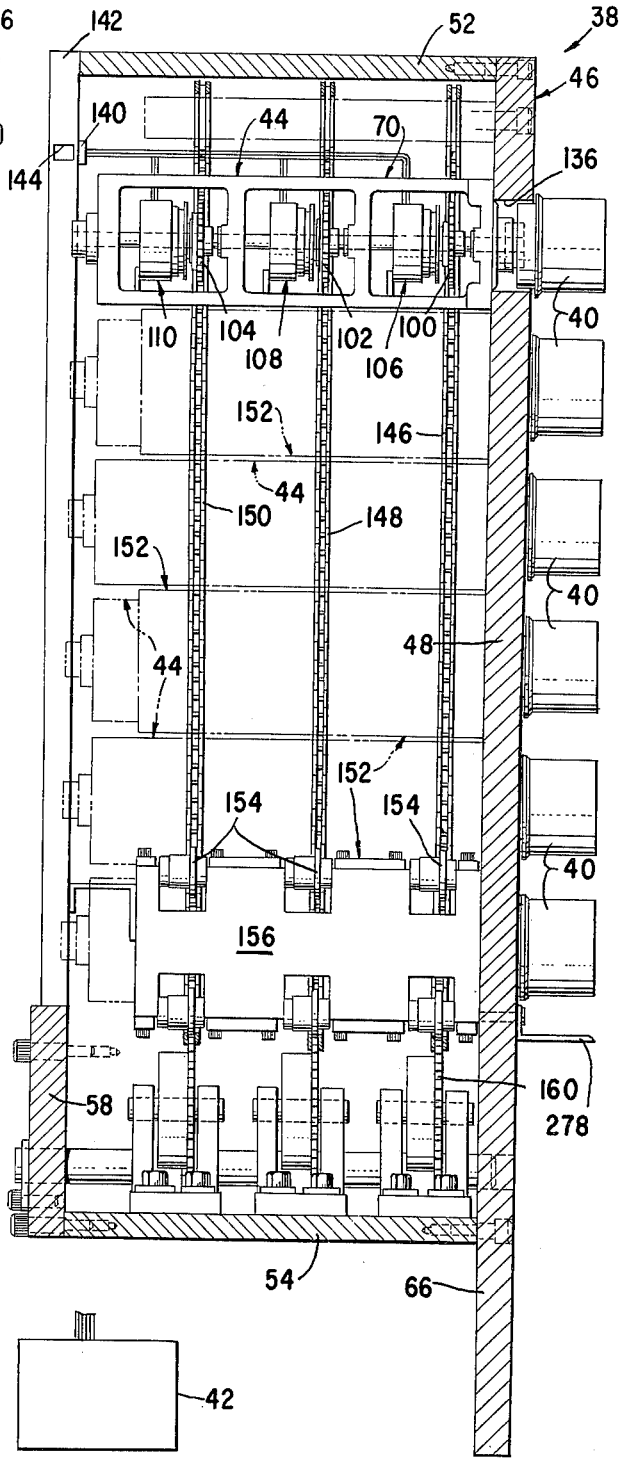
FIG. 5 is a vertical sectional view taken substantially along lines 5—5 of FIG. 2.
Figure 7:
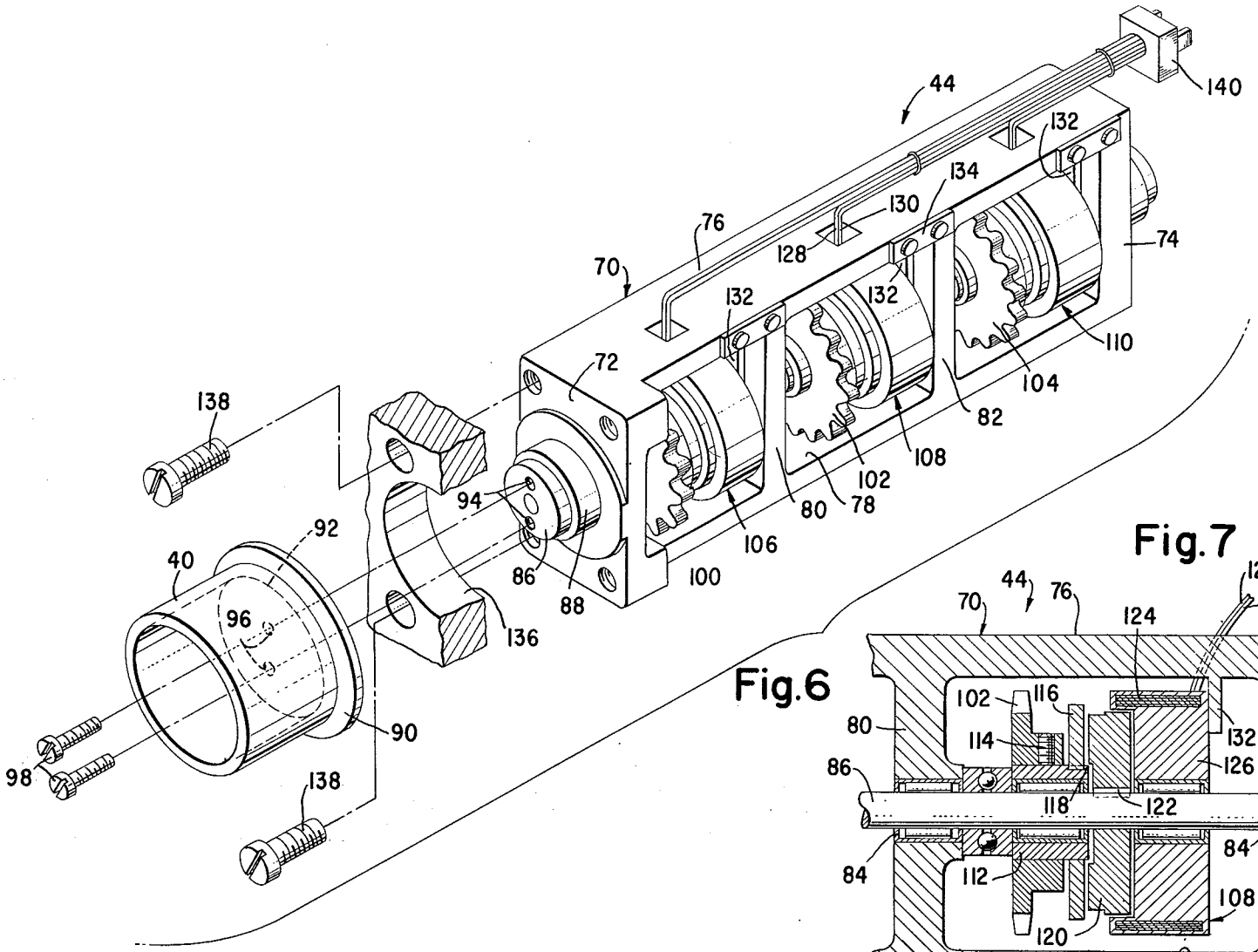
FIG. 7 is a cross sectional view taken through a portion of one yarn feed module.
Figure 6:
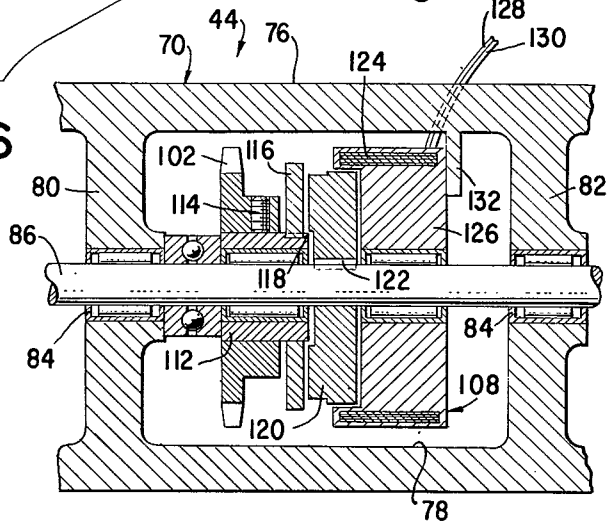
FIG. 6 is an enlarged perspective view of one yarn feed module illustrating the manner in which it is mounted in the frame of the assembly.

Each roller module 44, as best illustrated in FIGS. 5 and 6, comprises a housing 70 which may be a casting having a substantially rectangular shape including a front wall 72 and a rear wall 74 interconnected by a top wall 76 and a bottom wall 78. The interior of the housing 70 is divided into a plurality of substantially equal size compartments, preferably three, for example, one for each discreet pile height desired to be produced in the fabric F, by means of walls 80 and 82 extending between the top and bottom walls 76 and 80. It should be understood that the number of pile heights may be more or less than three and that therefore more or less than the three illustrated compartments including the elements positioned therein are within the scope of this invention. Each of the walls 72, 80, 82 and 84 includes a longitudinally aligned hole within each of which is fitted a bearing 84, two of which are illustrated in FIG. 7. A shaft 86 extends longitudinally through the housing and is journalled in the bearings 84. The shaft extends out the front wall 72 of the housing for mounting a hub 88. Each roller 40 comprises a cylindrical shaped member having an annular sleeve portion 90 adapted to be received on the hub 88 and an internal disk member 92 adapted to abut the end of the shaft 86. The shaft and the disk may respectively have holes 94 and 96 which register to receive screws 98 for securing the roller to the shaft. As is conventional, the outer surface of the roller may have a frictional material such as a sand paper or the like coated thereon for positive feeding of the yarn.

Rotatably mounted on the shaft 86 within each compartment of the housing 70 is a drive member such as sprockets 100, 102 and 104 and an associated clutch 106, 108 and 110 respectively. As illustrated in FIG. 7 with regard to the intermediate compartment, the sprocket 102 is fixed to a hub member 112 by means of a set screw 114 and the hub is journalled for rotation on the shaft 86. The clutch 108 includes an armature member 116 mounted on the hub 112 by means of a spline 118 or similar coupling so that the armature is fixed for rotation with the hub 112 but may move axially thereon relative to the shaft 86. The clutch also includes a rotor member 120 fixed to the shaft 86 by means of a key 122. A torus shaped coil 124 mounted in a stationary field housing 126 within which the rotor 120 rotates is concentrically positioned about the shaft. Electrical power from a selective source such as the pattern control 42 is supplied through electrical conductors such as leads 128 and 130 to the coil 126. Each field housing is affixed to the module housing 70 by means of a bracket 132 secured to the field housing 126 and to a clip 134 on the top of the housing 70. When the coil receives electrical current it becomes energized and the armature 116 is attracted into frictional engagement with the rotor 120 thereby transferring the rotation of the armature to the rotor and thus to the shaft 86. The armature is rotated by its coupling to the sprocket and the sprocket is rotated as hereinafter described. It should be understood that although only sprocket 102 and clutch 108 has been described in detail the construction of the sprockets 100 and 104 and the clutches 106 and 110 is similar.

The modules 44, which may equal in number to the number of needles, are mounted in a plurality of rows in the frame 46, there being a plurality of modules in each row. Preferably the rows are aligned as illustrated in FIG. 2, but staggering of the rows may be desirable and is within the scope of the invention. The wall 48 of the frame 46 includes a multiplicity of apertures 136. The modules are mounted in cantilevered fashion with the rollers 40 extending through the apertures 136 by means which may for example be screws 138 extending through the wall 48 about the apertures and threadedly received within the wall 72 of the module. Since the modules are of substantially the same construction, all the sprockets 100 lie in a substantially common plane, all the sprockets 102 lie in a substantially common plane, and all the sprockets 104 lie in a substantially common plane, these planes being substantially parallel to the wall 48. The leads 128 and 130 from each clutch unit 108, together with the leads from the other clutches 106 and 110 of each module are brought into a common electrical connector 140 at the rear of each module. Mounted on the rear of the frame 46 are a plurality of U-shaped conduits 142 each having a multiplicity of electrical receptacles 144. The conduits may be mounted between each two vertical rows of modules and include a separate receptacle independently servicing each module in those rows. The conduits 144 neatly contain the electrical leads from the pattern control to each module connector 140.

It should be understood that all the corresponding sprockets 100 are driven at a first speed, all the corresponding sprockets 102 are driven at a second speed, and all the corresponding sprockets 104 are driven at a third speed. Moreover, these three speeds differ from one another so that the rollers 40 may selectively be driven at any of the three different speeds. In order to drive the sprockets a separate endless chain is provided for the corresponding co-planar sprockets. Thus, a chain 146 extending in the plane of the sprockets 100 snakes about the frame 46 in serpentine-like fashion so as to be trained about and mesh with all the sprockets 100. The path of the chain from the first vertical row of roller modules to the last row is substantially horizontal at the lower most portion of the frame 46 but thereafter snakes up and down the vertical rows. In a similar fashion a chain 148 snakes its ways to the frame to be trained about and mesh with all the sprockets 102, and a chain 150 takes a similar path and is trained about and meshes with the sprockets 104. Each of the chains may be guided against the sprockets by means of a multiplicity of idler members 152. Each idler 152 may comprise an idler sprocket 153 as illustrated in FIG. 1, or a chain roller 154 as illustrated in FIG. 5. The idlers 152 are mounted three on a shaft with each of the three idlers coacting with one of the three chains 146, 148 and 150. Preferably there are two such shafts to an idler assembly which includes a housing 156 for supporting the two shafts as a module. Preferably there is one idler in the path of the chain between each two vertically spaced roller modules, and two idlers supporting the chains on the horizontal path between rows at the top of the frame 46. The housing 156 is mounted on the front wall 48 in cantilevered fashion in a similar manner as the yarn feed modules by means of bolts 158. Each chain may also extend about adjustable tensioning sprockets such as 159 and 160 and a fixed guide sprocket 162 as illustrated for the chain 146. Motion is drivingly transmitted to the chains 146, 148 and 150 by means of respective driving sprocket 164, 166 and 168 about which the chains are trained.

Mounted in the lower portion of the frame adjacent the drive box 60, are three drive arm assemblies 170, 172 and 174 each of which may comprise a body having bifurcated arms on one end and a hub on the other end. Adjacent their extremities each pair of bifurcated arms 176 and 178, 180 and 182, 184 and 186 include an aligned bored hole. The arms are aligned so that a stud shaft 188, supported on its ends in the plates 48 and 58, may be received therethrough. Journalled on the shaft 188 between the arms 176 and 178 is the driving sprocket 164 and a sprocket 190. The sprockets 164 and 190 are secured together as a unit so as to rotate together on the shaft 188. Similarly the sprocket 166 is secured to a sprocket 192 and journalled on the shaft between the arms 180 and 182 of the assemblies 172, and the sprocket 168 is secured to a sprocket 194 and journalled between arms 184 and 186 on shaft 188. The hub end of each of the assemblies 170, 172 and 174 includes a bore within which is journalled a respective shaft 196, 198 and 200. Secured to one end of the shaft 196 is a sprocket 202 which is aligned in a plane common with the sprocket 190. Another sprocket 204 is secured to the other end of the shaft 196 so that the shaft and the sprocket 202 may rotate together with the sprocket 204. A chain 206 is trained about the sprocket 202 and 190 so that sprocket 190 may be driven by the sprocket 202. Similarly, sprockets 208 and 210 are mounted on shaft 198 and a chain 212 drives the sprocket 102, and sprockets 214 and 216 are mounted on shaft 200 and chain 218 drives the sprocket 194.

To support the hub end of the assemblies 170, 172 and 174 there is provided a respective rod 220, 222 and 224 pivotably secured to the body of the respective assembly. Each rod 220, 222 and 224 extends upwardly and is adjustably fastened at its upper end to the plate 56 by means of respective bolts and lock washers 226, 228 and 230. The bolts are positioned within respective slots 232, 234 and 236 and the washers clamp on one side against the wall 58 while a small plate 238, 240 and 242 clamp against the other side. For reasons which will become apparent, the bolts are adjustable within the slots to adjustably position the rods to pivot the assemblies about the shaft 188.

Each of the sprockets 204, 210, 216 is drivingly connected to a respective sprocket 244, 246 and 248 mounted within the drive box 60 by means of respective chains 250, 252 and 254 trained about the sprockets. Each of the sprockets 244, 246 and 248 is mounted on one end of a respective shaft 256, 258 and 260 journalled in the box 60 in the other end of which is mounted a respective sprocket 262, 264 and 266. Mounted on the floor 54 of the frame 46 within the box 60 is a speed reducer 268 having an input shaft 270 which is driven by means such as a belt and pulley arrangement (not shown) from the main shaft 32 of the tufting machine. The take-off shaft 272 of the reducer 268 mounts a sprocket 274. A chain 276 is trained about all the sprockets 262, 264, 266 and 274 so as to drive the shaft 256, 258 and 260 and thereby the sprockets 244, 246 and 248. It should be understood that the sprockets 244, 246, 248, 204, 210 and 216 are sized so that the sprockets 100, 102 and 104 in the yarn roller modules are driven at different speeds dependent on the pile height desired in the work product. When another set of pile heights are desired in the work product, a change in the sprockets 244, 246 and 248 is made and if necessary sprockets 204, 210 and 216 may also be changed. When these changes are made it may be necessary to re-tension the chains 250, 252 and 254. This is accomplished by loosening the bolts 226, 228 and 230 and repositioning them in the slots 232, 234 and 236. This effects a pivoting of the assemblies 170, 172 and 174 about the shaft 188 as the rods 220, 222 and 224 are adjusted to re-tension the chains 250, 252 and 254.

In operation, yarn Y is brought from a creel (not shown) or the like and guided into the assembly 38. The yarn extends down through holes in an uppermost yarn guide 278 down about a drag pin 280 mounted on the wall 248 at a lower side portion of the rollers 240. The yarn is then wound upwardly about the friction surfaces of the rollers 40 which are selectively driven at one of the three speeds of the serpentine chains. The yarn contacts the roller over a substantial portion of the friction surfaces, preferably about 220 degrees, and is guided downwardly through the holes in the next and succeeding rows of yarn guides 278 to the tufting machine. In accordance with the pattern in the control 42, one of the three clutches 106, 108 or 110 of each yarn feed module 44 is energized so that its associated sprocket 100, 102 or 104 is coupled to the shaft 86 and thereby to the roller 40. Thus, yarn is fed to each needle in accordance with the amount called for by the pattern control 42. Since the assembly is of such a compact size, e.g. the length of each module is approximately 10 inches and less than 2 inches by 3 inches in width and height, it may be adopted to single needle control by stacking one module for each needle.

To service the assembly when, the example, a clutch needs to be replaced, merely requires that the plugs 140 be pulled from the receptacles 144. The screws 98 are then removed to remove the rollers 40 to obtain access to the screws 138 which are then removed. The yarn feed module can then be slid over to the clearance space between the vertical rows so as to disengage the sprockets 100, 102 and 104 from the chains 146, 148 and 150. The modules are then removed out the back of the frame. Another module can be slipped in by reversing the procedure. Similarly, the tensioning modules 156 may be removed by merely removing screw 156 and slipping the units from the chains and out the back.

Numerous alterations of the structure herein disclosed will suggest themselves to those skilled in the art. For example pulley and toothed belt means rather than the chains and sprockets described may be used as the driving members. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, but we claim herein is:

1. A feed roller assembly for a tufting machine pattern attachment comprising, a support, a multiplicity of parallel roller modules mounted in the support, each of said modules comprising a housing, a shaft rotatably journalled in the housing, a plurality of drive members rotatably journalled on said shaft, a yarn feed roller mounted on one end of said shaft adapted to feed yarn to at least one needle of the tufting machine, the amount of yarn fed being dependent on the speed of the roller, drive transmitting means in the support for driving corresponding drive members of said modules in unison at a speed different from the other drive members, a clutch associated with each drive member mounted on said shaft, means drivingly connecting each drive member to the respective associated clutch for rotating the clutch, each said clutch being operable when actuated to rotate said shaft, and means for selectively actuating the clutches of each module.

2. A feed roller assembly as recited in claim 1 wherein each module housing is cantilevered on said support.

3. A feed roller assembly as recited in claim 1 where each said clutch comprises a first element fixed to said shaft and a second element fixed for rotation with the associated drive member and axially movable relative to said shaft.

4. A feed roller assembly as recited in claim 1 wherein said drive members comprise disk-like members having peripheral teeth and said drive transmitting means comprises an endless flexible element in driving engagement with the teeth of the corresponding disk-like members of each module, and means for driving each endless element at a speed different from the other endless elements.

5. A feed roller assembly as recited in claim 4 wherein said modules are disposed in a plurality of rows, each row comprising a plurality of modules, the corresponding sprockets of all the modules being disposed in a common plane, and each of said endless flexible elements forms a serpentinelike path within the corresponding plane.

6. A yarn feed roller assembly as recited in claim 5 wherein said disk-like members comprise sprockets and said endless flexible elements comprise chains.

7. A feed roller assembly as recited in claim 6 wherein said support includes a wall substantially parallel to said planes, an aperture for each yarn feed roller found in said wall, each of said modules being cantilevered on said wall and having the yarn feed roller extending through the respective aperture.

8. A yarn feed roller assembly as recited in claim 6 including means for guiding each said chain within said path and into engagement with the corresponding sprockets, said means comprising a housing, at least one shaft mounted in said housing, idler means mounted on said shaft disposed within the planes of said chains for engaging each chain, and means for mounting said housing in cantilevered fashion on said wall.

9. A yarn feed roller module for a tufting machine pattern attachment, comprising a housing, a shaft rotatably journalled in the housing, a plurality of drive members rotatably journalled on said shaft, a clutch associated with each drive member mounted on said shaft, said clutch having a first element fixed for rotation with said shaft and a second element axially movable relative to said shaft, the associated drive member being rotatably fixed to said axially movable element, and a yarn feed roller mounted on one end of said shaft.

10. A yarn feed roller module as recited in claim 9 wherein said clutches are electro-magnetically actuated, said module includes electrical conducting means connected at one end to each clutch, and a quick-connect electrical coupling connected to the other end of each conducting means.

11. A yarn feed roller module as recited in claim 9 wherein each drive member comprises a disk having peripheral teeth.

12. A yarn feed roller module as recited in claim 9 wherein said housing includes means for detachably mounting said module in cantilever fashion on a wall.

* * * * *